US010746445B2

(12) United States Patent
Kim

(10) Patent No.: US 10,746,445 B2
(45) Date of Patent: Aug. 18, 2020

(54) REFRIGERATOR

(71) Applicant: LG ELECTRONICS INC., Seoul (KR)

(72) Inventor: Hosan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 224 days.

(21) Appl. No.: 15/188,248

(22) Filed: Jun. 21, 2016

(65) Prior Publication Data

US 2016/0370046 A1 Dec. 22, 2016

(30) Foreign Application Priority Data

Jun. 22, 2015 (KR) ..... 10-2015-0088507
Jul. 28, 2015 (KR) ..... 10-2015-0106879

(51) Int. Cl.
*F25B 47/02* (2006.01)
*F25B 39/00* (2006.01)
(Continued)

(52) U.S. Cl.
CPC ..... *F25B 47/025* (2013.01); *F25B 39/00* (2013.01); *F25B 41/04* (2013.01); *F25D 11/02* (2013.01);
(Continued)

(58) Field of Classification Search
CPC ..... F25B 47/02; F25B 47/022; F25B 47/025; F25B 47/027; F25B 41/04; F25B 41/043;
(Continued)

(56) References Cited

U.S. PATENT DOCUMENTS 2,875,595 A * 3/1959 Kleist ..... F25D 11/006 165/122
2,969,959 A * 1/1961 Kuhn ..... F25B 13/00 165/232
(Continued)

FOREIGN PATENT DOCUMENTS

DE 288207 3/1991
DE 102014225102 A1 * 6/2016 ..... F25D 11/022
FR 2571127 A3 * 4/1986 ..... F25B 13/00

OTHER PUBLICATIONS

Extended European Search Report issued in European Application No. 16172645.0 dated Oct. 28, 2016, 8 pages.

*Primary Examiner* — Jianying C Atkisson
*Assistant Examiner* — Miguel A Diaz
(74) *Attorney, Agent, or Firm* — Fish & Richardson P.C.

(57) ABSTRACT

A refrigerator includes a compressor that is configured to compress refrigerant. The refrigerator further includes a condenser that is configured to condense compressed refrigerant. The refrigerator further includes a first expander that is configured to depressurize condensed refrigerant. The refrigerator further includes an evaporator that is configured to evaporate depressurized refrigerant. The refrigerator further includes a first valve unit that is located at an outlet side of the compressor and that is configured to guide compressed refrigerant from the compressor to the condenser. The refrigerator further includes a second valve unit that is located at an outlet side of the condenser and that is configured to guide condensed refrigerant from the condenser to the evaporator. The refrigerator further includes a hot gas path that is connected to the first valve unit and that is configured to supply compressed refrigerant from the compressor to the evaporator.

9 Claims, 19 Drawing Sheets

(51) Int. Cl.

| | |
|---|---|
| ***F28F 1/32*** | (2006.01) |
| ***F25B 41/04*** | (2006.01) |
| ***F25B 39/02*** | (2006.01) |
| ***F25D 11/02*** | (2006.01) |
| ***F25D 23/00*** | (2006.01) |
| ***F28D 1/047*** | (2006.01) |
| ***F28F 9/013*** | (2006.01) |

(52) U.S. Cl.
CPC ..... *F25D 23/006* (2013.01); *F28D 1/0477* (2013.01); *F28F 1/325* (2013.01); *F28F 9/0131* (2013.01); *F25B 39/02* (2013.01); *F25B 2341/0661* (2013.01); *F25D 2321/1441* (2013.01)

(58) Field of Classification Search
CPC ..... F25B 41/046; F25B 2400/0409; F25B 2400/05; F25B 13/00; F25B 2341/144; F25B 2341/1441; F25B 2341/0661; F25B 2313/0211; F25B 2313/02322; F25B 2313/02332; F25B 2313/02741; F25B 2347/021; F25D 2321/144; F25D 2321/1441; F25D 2321/1411; F25D 21/12; F28F 1/325; F28F 1/0477
See application file for complete search history.

(56) References Cited

U.S. PATENT DOCUMENTS 3,015,939 A * 1/1962 Brainard ..... F25B 29/003 62/156
3,167,930 A * 2/1965 Rasovich ..... F25B 13/00 62/81
3,209,814 A * 10/1965 Block ..... F25B 43/00 165/62
3,213,637 A * 10/1965 Halls ..... F25B 47/022 62/151
3,386,259 A * 6/1968 Kirkpatrick ..... B60H 1/00007 62/156
3,677,025 A * 7/1972 Payne ..... F25B 47/022 62/155
3,978,684 A * 9/1976 Taylor ..... F25B 13/00 62/324.3
4,043,144 A * 8/1977 Klotz ..... F25B 47/022 62/196.4
4,215,555 A * 8/1980 Cann ..... F25B 13/00 62/324.2
4,369,350 A * 1/1983 Kobayashi ..... F25D 21/08 219/201
4,722,388 A * 2/1988 Drury ..... F25B 39/00 165/164
5,050,400 A * 9/1991 Lammert ..... F25B 47/022 62/196.4
5,315,836 A * 5/1994 Ressler ..... F25B 47/022 62/277
5,784,896 A * 7/1998 Tronnes ..... F25D 17/062 62/285
5,809,789 A 9/1998 Baker et al.
5,896,753 A * 4/1999 Kwak ..... F25B 5/00 62/324.3
6,318,107 B1 * 11/2001 Pandaru ..... F25D 21/12 62/118
6,378,204 B1 * 4/2002 Kim ..... B21D 53/085 29/890.043
8,561,420 B2 * 10/2013 Kakizaki ..... B60H 1/3233 62/150
2002/0078705 A1 * 6/2002 Schlosser ..... F25B 5/02 62/352
2005/0126197 A1 * 6/2005 Kim ..... F24F 13/222 62/275
2012/0023993 A1 * 2/2012 Palmer ..... F25D 21/08 62/276
2013/0174589 A1 * 7/2013 Wightman ..... F25B 13/00 62/81
2014/0151011 A1 * 6/2014 Kim ..... F28D 1/0477 165/185
2014/0216092 A1 * 8/2014 Tashiro ..... F25B 47/02 62/276
2014/0260364 A1 * 9/2014 Litch ..... F25B 39/02 62/82
2015/0121913 A1 * 5/2015 Kato ..... F25B 47/025 62/81
2016/0047606 A1 * 2/2016 Wada ..... F28D 1/0477 62/498
2016/0061536 A1 * 3/2016 Arment ..... B23P 15/26 165/181
2016/0153697 A1 * 6/2016 Hamamoto ..... B60H 1/00921 62/140
2016/0187048 A1 * 6/2016 Jeong ..... F25D 11/006 62/187
2016/0209125 A1 * 7/2016 Hanlon ..... F28F 19/006
2016/0370046 A1 * 12/2016 Kim ..... F25B 47/025
2017/0030619 A1 * 2/2017 Kim ..... F25B 5/04
2017/0030627 A1 * 2/2017 Kim ..... F25D 11/022
2017/0131018 A1 * 5/2017 Shin ..... F25D 21/06
2017/0241693 A1 * 8/2017 Tajika ..... F25B 47/022
2017/0274732 A1 * 9/2017 Galansky ..... F25B 41/003
2017/0276422 A1 * 9/2017 Chamoun ..... F25D 21/04
2017/0336114 A1 * 11/2017 Lee ..... F25B 47/022

* cited by examiner

REFRIGERATOR

CROSS-REFERENCE TO RELATED APPLICATIONS

This application claims priority under 35 U.S.C. § 119 and 35 U.S.C. § 365 to Korean Patent Application No. 10-2015-0088507, filed in Korea on Jun. 22, 2015, and No. 10-2015-0106879, filed in Korea on Jul. 28, 2015 whose entire disclosure is hereby incorporated by reference.

FIELD

This application relates to a refrigerator.

BACKGROUND

Generally, a refrigerator has a plurality of storage compartments which accommodate stored goods and keep food refrigerated or frozen, and one surface of each of the storage compartments is formed to be opened, such that the food is accommodated or taken out therethrough. The plurality of storage compartments includes a freezer compartment in which the food is kept frozen, and a refrigerator compartment in which the food is kept refrigerated.

A refrigeration system in which a refrigerant is circulated is driven in the refrigerator. The refrigeration system includes a compressor, a condenser, an expander and an evaporator. Cooling air stored in the freezer compartment is cooled while passing through the evaporator, and then supplied again into the freezer compartment, and at least some of the cooled cooling air may be supplied into the refrigerator compartment.

SUMMARY

The present disclosure is directed to a refrigerator that is able to perform a defrosting operation of an evaporator using a high temperature refrigerant.

According to an innovative aspect of the subject matter described in this application, a refrigerator includes a compressor that is configured to compress refrigerant; a condenser that is configured to condense compressed refrigerant; a first expander that is configured to depressurize condensed refrigerant; an evaporator that is configured to evaporate depressurized refrigerant; a first valve unit that is located at an outlet side of the compressor and that is configured to guide compressed refrigerant from the compressor to the condenser; a second valve unit that is located at an outlet side of the condenser and that is configured to guide condensed refrigerant from the condenser to the evaporator; and a hot gas path that is connected to the first valve unit and that is configured to supply compressed refrigerant from the compressor to the evaporator.

The refrigerator may include one or more of the following optional features. The hot gas path includes a first connection path that extends from the first valve unit to the evaporator; and a second connection path that extends from the evaporator to the second valve unit. The first valve unit includes a four-way valve that includes four ports, and that includes a first port that is connected to an outlet pipe of the compressor; a second port that is connected to an inlet pipe of the condenser; and a third port that is connected to the first connection path. The refrigerator further includes a third connection path that extends from the first valve unit to a suction side pipe of the compressor. The first valve unit further includes a fourth port that is connected to the third connection path. The refrigerator further includes an evaporator inlet pipe that is connected to the first expander and that is configured to guide refrigerant into the evaporator; and an evaporator outlet pipe that is configured to guide refrigerant from the evaporator to the compressor. The evaporator includes a first pipe that is connected to the evaporator inlet pipe; a second pipe that is connected to the first connection path and that is connected to the second connection path; and a fin that is coupled to the first pipe and the second pipe.

The second valve unit includes a three-way valve that includes three ports, and that includes a first port that is connected to a pipe that connects the condenser with the second valve unit; a second port that is connected to the evaporator inlet pipe; and a third port that is connected to the second connection path. The refrigerator further includes a second expander that is connected to the second connection path. The first expander or the second expander includes a capillary tube. Based on performing a first operation mode the first valve unit is configured to guide refrigerant from the compressor to the condenser, and the second valve unit is configured to guide refrigerant from the condenser to the first expander. Based on performing a second operation mode the first valve unit is configured to guide refrigerant from the compressor to the hot gas path and is configured to guide refrigerant from the condenser to a suction side pipe of the compressor, and the second valve unit is configured to guide refrigerant from the hot gas path to the condenser. The fin includes a first through-hole that is configured to receive the first pipe; and a second through-hole that is configured to receive the second pipe passes and that has an inner diameter that is smaller than an inner diameter of the first through-hole. The first through-hole and the second through-hole are aligned along an axis that is perpendicular to a front of the refrigerator.

The fin further includes a plurality of additional through-holes that are similar to the first through hole. The second through-hole is located among the plurality of additional through-holes and the first through-hole. The refrigerator further includes a water collection part that is located at a lower side of the evaporator and that is configured to receive ice or water condensed on the evaporator; and an extension part that is located at the second pipe, that is located inside the water collection part, and that is configured to melt ice in the water collection part by providing heat. The extension part is located below the fin. The water collection part includes a discharge part that is configured to receive defrosted water from the water collection part, and that includes an inclined surface that is inclined downward from both sides of the water collection part toward the discharge part. The extension part includes an inclined surface that is inclined at an angle similar to the inclined surface of the water collection part.

According to another innovative aspect of the subject matter described in this application, a refrigerator includes a compressor that is configured to compress a refrigerant; a condenser that is configured to condense compressed refrigerant; a first expander that is configured to depressurize condensed refrigerant; an evaporator that includes a first pipe that is configured to evaporate depressurized refrigerant and that includes a second pipe that is configured to guide refrigerant during a defrosting operation; a first valve unit that is located at an outlet side of the compressor and that is configured to guide compressed refrigerant from the compressor to the condenser; a second valve unit that is located at an outlet side of the condenser and that is configured to guide condensed refrigerant from the condenser to the evaporator; a first connection path that extends from the first valve unit toward the second pipe of the evaporator; a second connection path that extends from the second pipe of the evaporator to the second valve unit; and a second expander that is located at the second connection path.

The refrigerator may include one or more of the following optional features. Based on cooling a storage compartment, the first valve unit and the second valve unit are configured to restrict flow of refrigerant in the first connection path and the second connection path. Based on defrosting the evaporator, the first valve unit and the second valve unit are configured to guide refrigerant through the first connection path, the evaporator, and the second connection path. The evaporator includes a first pipe that is connected to the evaporator inlet pipe; a second pipe that is connected to the first connection path and that is connected to the second connection path; and a fin that is coupled to the first pipe and the second pipe. The fin includes a plurality of first through-holes that are configured to receive the first pipe; and a plurality of second through-holes that are configured to receive the second pipe and that each have an inner diameter that is smaller than an inner diameter of each first through-hole. The plurality of first through-holes and the plurality of second through-holes are alternately positioned. The evaporator includes a plurality of coupling plates that are configured to support both sides of the first pipe and the second pipe; a water collection part that is located at a lower side of the evaporator and that is configured to receive ice or water condensed from the evaporator; and an extension part that is located at the second pipe and that is located inside the water collection part.

BRIEF DESCRIPTION OF THE DRAWINGS

FIGS. 11 and 12 are views of example installed freezer compartment evaporators.

DETAILED DESCRIPTION

Figure 1:
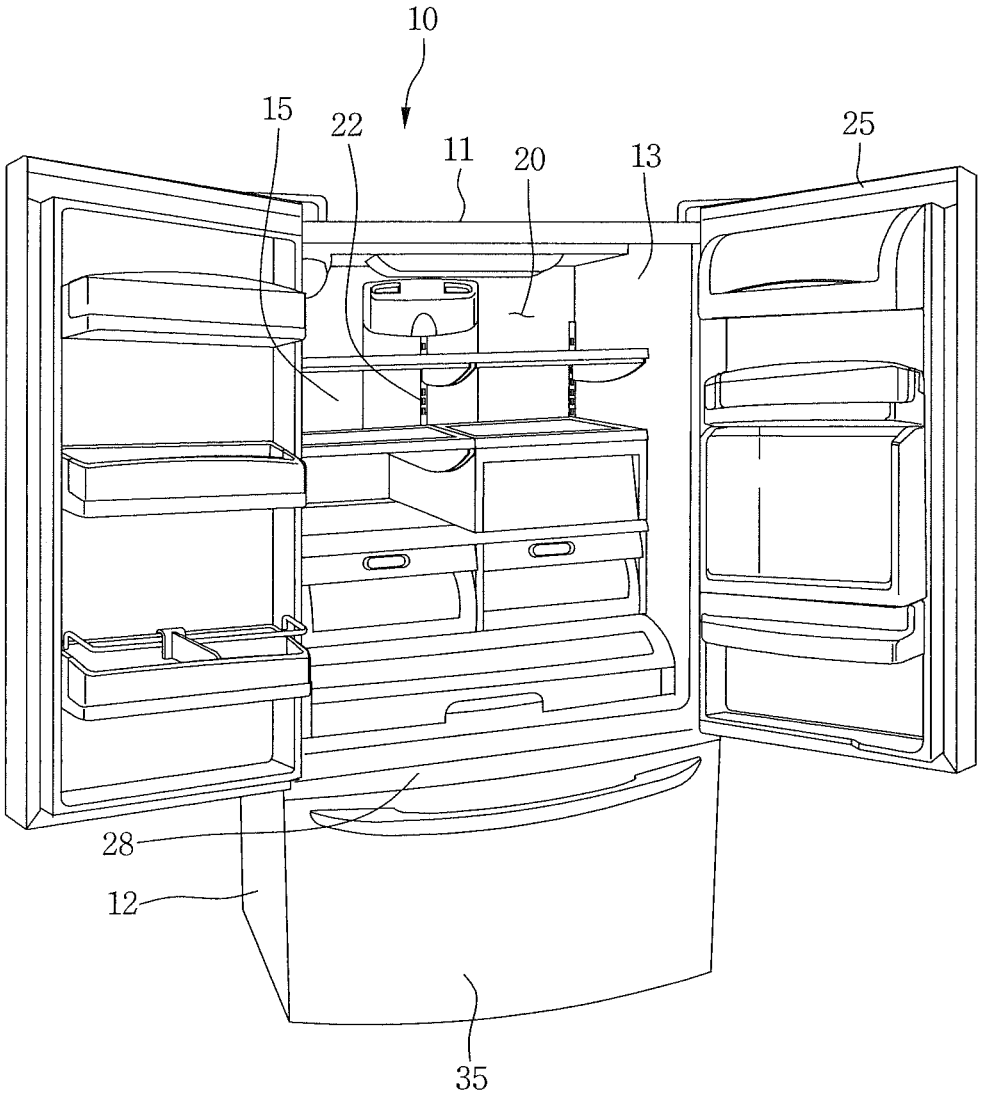
FIG. 1 is a perspective view of an example configuration of an example refrigerator.
Figure 2:
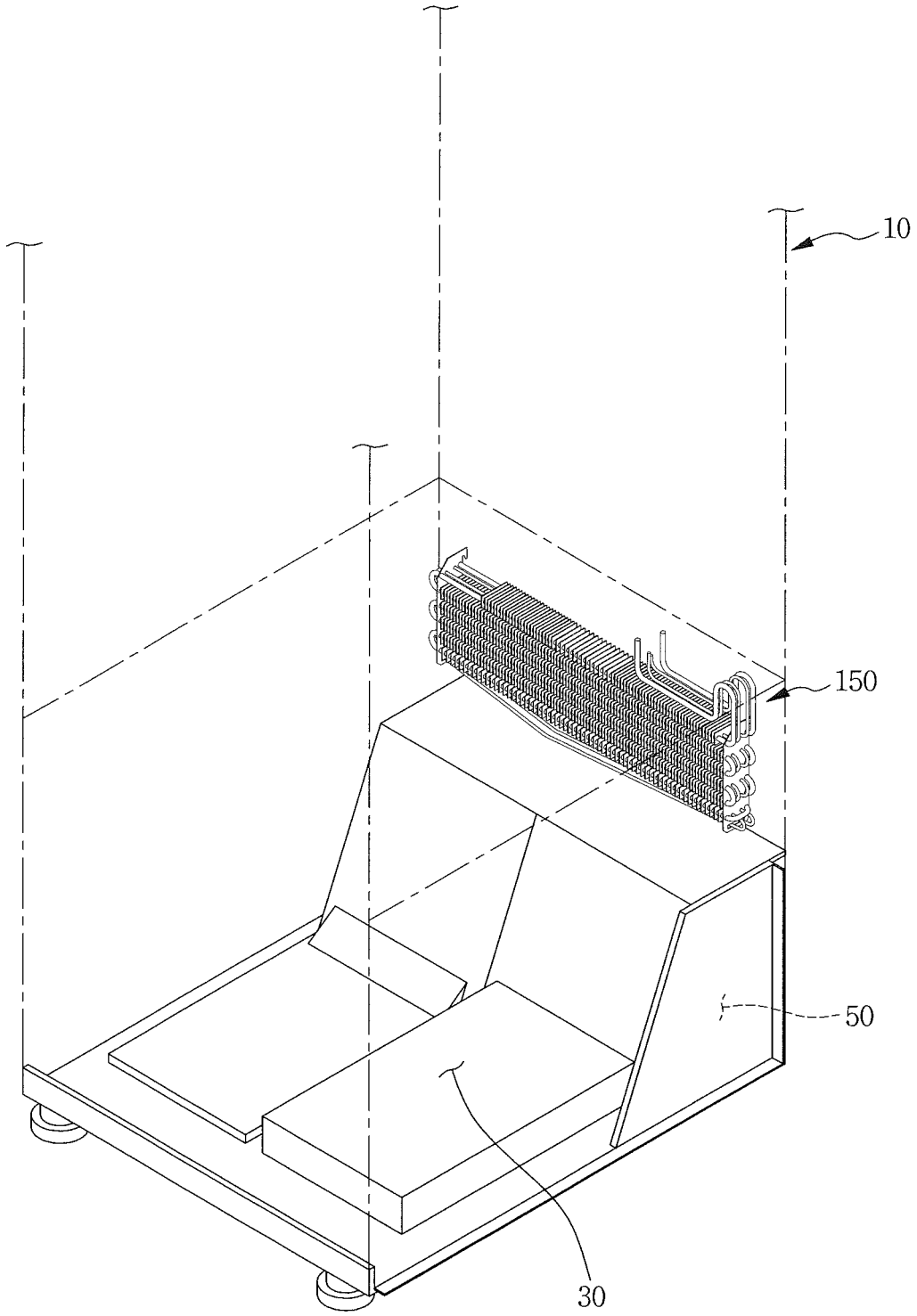
FIG. 2 is a view of a partial configuration of an example refrigerator.
Figure 3:
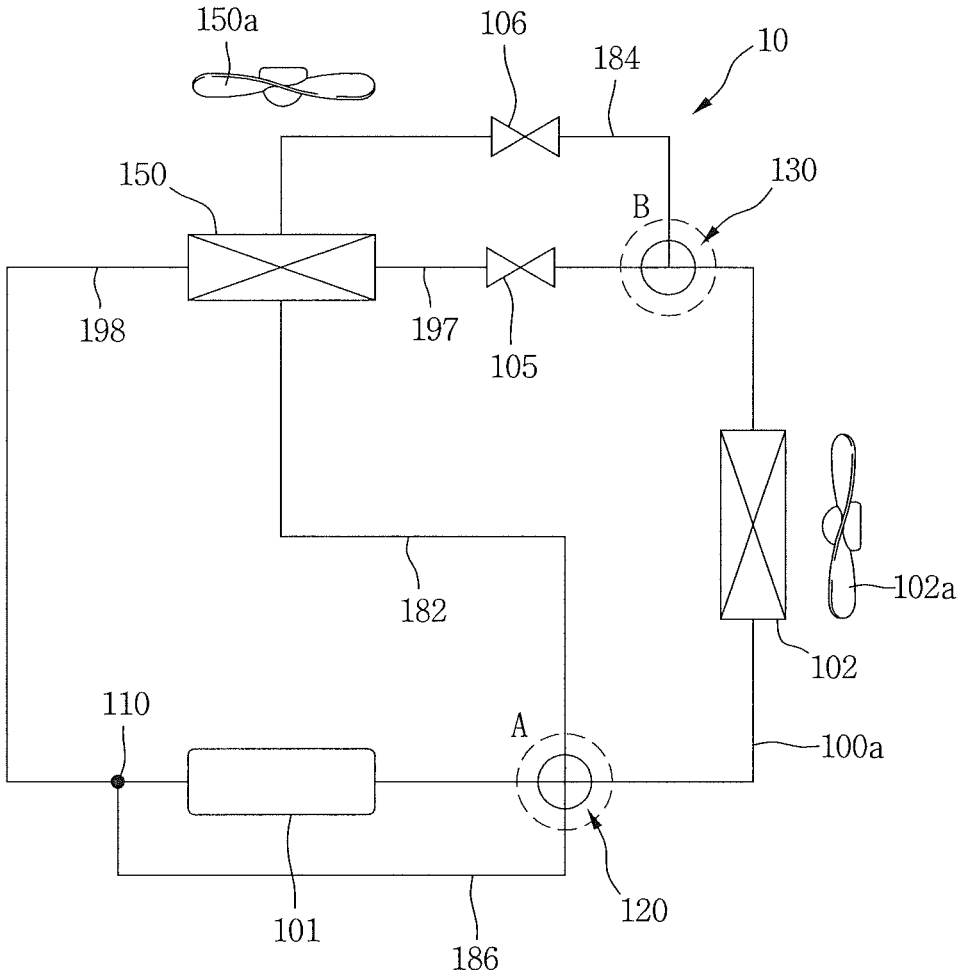
FIG. 3 is a cycle view of an example configuration of an example refrigerator.
Figure 4:
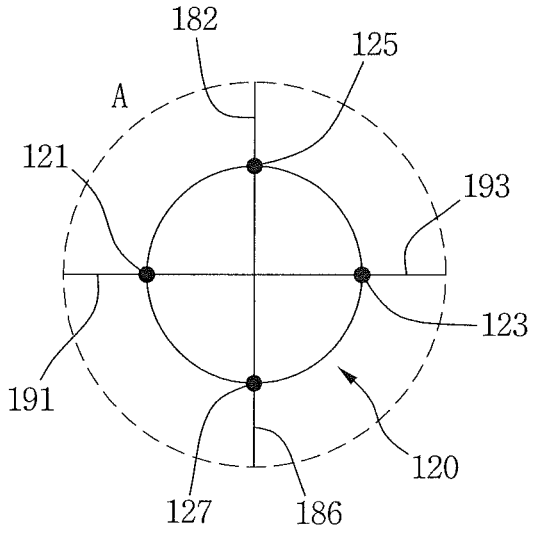
FIG. 4 is an enlarged view of an A portion of FIG. 3.
Figure 5:
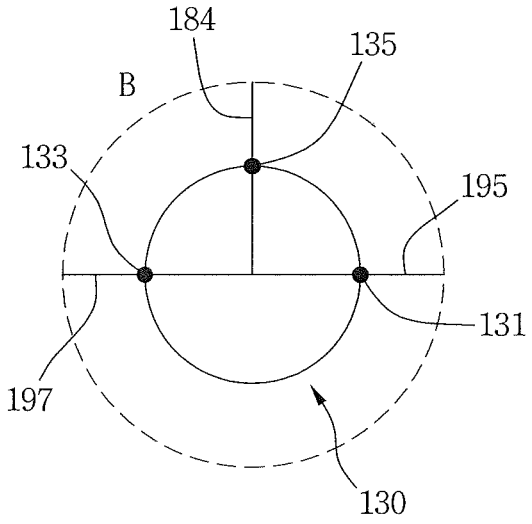
FIG. 5 is an enlarged view of a B portion of FIG. 3.

FIGS. 1-3 illustrate example refrigerators. FIG. 4 illustrates an A portion of FIG. 3. FIG. 5 illustrates a B portion of FIG. 3.

Referring to FIGS. 1 to 5, a refrigerator 10 includes a cabinet 11 which forms a storage compartment. The storage compartment includes a refrigerator compartment 20 and a freezer compartment 30. For example, the refrigerator compartment 20 may be disposed at an upper side of the freezer compartment 30. However, positions of the refrigerator compartment 20 and the freezer compartment 30 are not limited thereto. The refrigerator compartment 20 and the freezer compartment 30 may be divided by a partition wall 28.

The refrigerator 10 includes a refrigerator compartment door 25 which opens and closes the refrigerator compartment 20 and a freezer compartment door 35 which opens and closes the freezer compartment 30. The refrigerator compartment door 25 may be hinge-coupled to a front of the cabinet 11 and may be formed to be rotatable, and the freezer compartment door 35 may be formed in a drawer type to be withdrawn forward.

A direction is defined. Based on the cabinet 11 of FIG. 1, a direction at which the refrigerator compartment door 25 is located is defined as a "front side", and an opposite direction thereof is defined as a "rear side", and a direction toward a side surface of the cabinet 11 is defined as a "lateral side".

And the cabinet 11 includes an outer case 12 which forms an exterior of the refrigerator 10, and an inner case 13 which is disposed inside the outer case 12 and forms at least a part of an inner surface of the refrigerator compartment 20 or the freezer compartment 30. The inner case 13 includes a refrigerator compartment side inner case which forms the inner surface of the refrigerator compartment 20, and a freezer compartment side inner case which forms the inner surface of the freezer compartment 30.

A panel 15 is provided at a rear surface of the refrigerator compartment 20. The panel 15 may be installed at a position which is spaced forward from a rear of the refrigerator compartment side inner case. A refrigerator compartment cooling air discharge part 22 for discharging cooling air to the refrigerator compartment 20 is provided at the panel 15. For example, the refrigerator compartment cooling air discharge part 22 may be formed of a duct, and may be disposed to be coupled to an approximately central portion of the panel 15.

In some implementations, a freezer compartment side panel may be installed at a rear wall of the freezer compartment 30, and a freezer compartment cooling air discharge part for discharging the cooling air to the freezer compartment 30 may be formed at the freezer compartment side panel. An installation space in which an evaporator 150 is installed may be formed at a space between the freezer compartment side panel and a rear portion of the freezer compartment side inner case.

The refrigerator 10 includes the evaporator 150 which cools each of the refrigerator compartment 20 and the freezer compartment 30. The evaporator 150 is disposed at a rear of the freezer compartment 30, and the cooling air generated from the evaporator 150 may be supplied into each of the refrigerator compartment 20 and the freezer compartment 30 through the refrigerator compartment cooling air discharge part 22 and the freezer compartment cooling air discharge part.

The evaporator 150 may be hooked to the inner case 13. For example, the evaporator 150 includes hooks 162 and 167 (referring to FIG. 6) which are hooked to the inner case 13.

The refrigerator 10 includes a plurality of devices for driving a refrigeration cycle. In some implementations, the refrigerator 10 includes a compressor 101 which compresses a refrigerant, a condenser 102 which condenses the refrigerant compressed by the compressor 101, a plurality of expanders 105 and 106 which depressurize the refrigerant, and the evaporator 150 which evaporates the refrigerant.

And the refrigerator 10 further includes a refrigerant pipe 100*a* which connects the compressor 101, the condenser 102, the expanders 105 and 106 and the evaporator 150 and guides a flow of the refrigerant.

The plurality of expanders 105 and 106 include a first expander 105 for expanding the refrigerant which will be introduced into the evaporator 150 in a first operation mode (a cooling mode) of the refrigerator 10, and a second expander 106 for expanding the refrigerant which will be introduced into the condenser 102 in a second operation mode (a defrosting mode) of the refrigerator 10. Each of the first and second expanders 105 and 106 may include a capillary tube.

The first expander 105 may be installed at an evaporator inlet pipe 197 installed at an inlet side of the evaporator 150. It is understood that the evaporator inlet pipe 197 is a pipe which extends from a second valve unit 130 to the evaporator 150. And the second expander 106 may be installed at a second connection path 184.

The refrigerator 10 further includes a first valve unit 120 which is disposed at an outlet side of the compressor 101 to guide the refrigerant compressed in the compressor 101 to the condenser 102 or the evaporator 150. The first valve unit 120 may be installed at the refrigerant pipe which connects the compressor 101 with the condenser 102. And the first valve unit 120 includes a four-way valve having four ports through which the refrigerant is introduced or discharged.

The refrigerator 10 further includes the second valve unit 130 which is installed at the refrigerant pipe connecting the condenser 102 with the evaporator 150, and guides the refrigerant condensed in the condenser 102 to the first expander 105 when the refrigerator 10 performs the first operation mode. The second valve unit 130 includes a three-way valve having three ports through which the refrigerant is introduced or discharged. Based on a refrigerant path during the first operation mode of the refrigerator 10, the first expander 105 may be located between the second valve unit 130 and the evaporator 150.

The refrigerator 10 further includes a first connection path 182 which extends from the first valve unit 120 to the evaporator 150, and the second connection path 184 which is connected to the first connection path 182 and extends from the evaporator 150 to the second valve unit 130.

The second connection path 184 and the evaporator inlet pipe 197 may be disposed in parallel. That is, each of the evaporator inlet pipe 197 and the second connection path 184 is a pipe which extends from the second valve unit 130 to the evaporator 150, and the second connection path 184 is connected in parallel with the evaporator inlet pipe 197. The evaporator inlet pipe 197 is connected to a first pipe 151 of the evaporator 150, and the second connection path 184 is connected to a second pipe 170 of the evaporator 150.

The first connection path 182 and the second connection path 184 are understood as "hot gas paths" which supply the high temperature refrigerant compressed in the compressor 101 during the second operation mode of the refrigerator 10 and defrost the evaporator 150. The hot gas paths 182 and 184 may be coupled to the evaporator 150.

The refrigerator 10 further includes a third connection path 186 which extends from the first valve unit 120 to a suction side pipe of the compressor 101. During the second operation mode of the refrigerator 10, the third connection path 186 guides the refrigerant passed through the condenser 102 to an inlet side of the compressor 101.

The refrigerant pipe 100*a* provided at the inlet side of the compressor 101 includes a combination part 110 to which the third connection path 186 is connected. During the second operation mode of the refrigerator 10, the refrigerant flowing through the third connection path 186 may be suctioned into the compressor 101 via the combination part 110.

A configuration of each of the first valve unit 120 and the second valve unit 130 will be described in detail. The first valve unit 120 includes four ports 121, 123, 125 and 127 which guide introduction or discharge of the refrigerant.

In some implementations, the first valve unit 120 includes a first port 121 connected to a compressor outlet pipe 191 which extends from the outlet side of the compressor 101 to the first valve unit 120. The first port 121 is understood as an inlet port which guides the high temperature refrigerant compressed in the compressor 101 to be introduced into the first valve unit 120.

The first valve unit 120 further includes a second port 123 connected to a condenser inlet pipe 193 which extends from the first valve unit 120 to the condenser 102. The second port 123 is understood as an outlet port which guides the refrigerant introduced into the first valve unit 120 to the condenser inlet pipe 193 during the first operation mode of the refrigerator 10. In some implementations, the second port 123 may be understood as an inlet port which introduces the refrigerant passed through the condenser 102 into the first valve unit 120 during the second operation mode of the refrigerator 10.

The first valve unit 120 further includes a third port 125 which is connected to the first connection path 182. The third port 125 is understood as an outlet port which guides the refrigerant introduced into the first valve unit 120 to the first connection path 182 during the second operation mode of the refrigerator 10.

The first valve unit 120 further includes a fourth port 127 which is connected to the third connection path 186. The fourth port 127 is understood as an outlet port which guides the refrigerant introduced into the first valve unit 120 to the third connection path 186 during the second operation mode of the refrigerator 10.

The second valve unit 130 includes three ports 131, 133 and 135. In some implementations, the second valve unit 130 includes a first port 131 connected to a condenser outlet pipe 195 which extends from the condenser 102 to the second valve unit 130. The first port 131 is understood as an inlet port which introduces the refrigerant passed through the condenser 102 to the second valve unit 130 during the first operation mode of the refrigerator 10. In some implementations, the first port 131 is understood as an outlet port which discharges the refrigerant introduced into the second valve unit 130 to the condenser outlet pipe 195 during the second operation mode of the refrigerator 10.

The second valve unit 130 further includes a second port 133 which is connected to the evaporator inlet pipe 197. The second port 133 is understood as an outlet port which discharges the refrigerant introduced into the second valve unit 130 to the evaporator inlet pipe 197 during the first operation mode of the refrigerator 10.

The second valve unit 130 further includes a third port 135 which is connected to the second connection path 184. The third port 135 is understood as an inlet port which introduces the refrigerant of the second connection path 184 into the second valve unit 130 during the second operation mode of the refrigerator 10.

The refrigerator 10 further includes fans 102*a* and 150*a* which are provided at one side of each of heat exchangers 102 and 150 to blow air. The fans 102*a* and 150*a* include a condenser fan 102*a* which is provided at one side of the condenser 102, and an evaporator fan 150*a* which is provided at one side of the evaporator 150.

Figure 6:
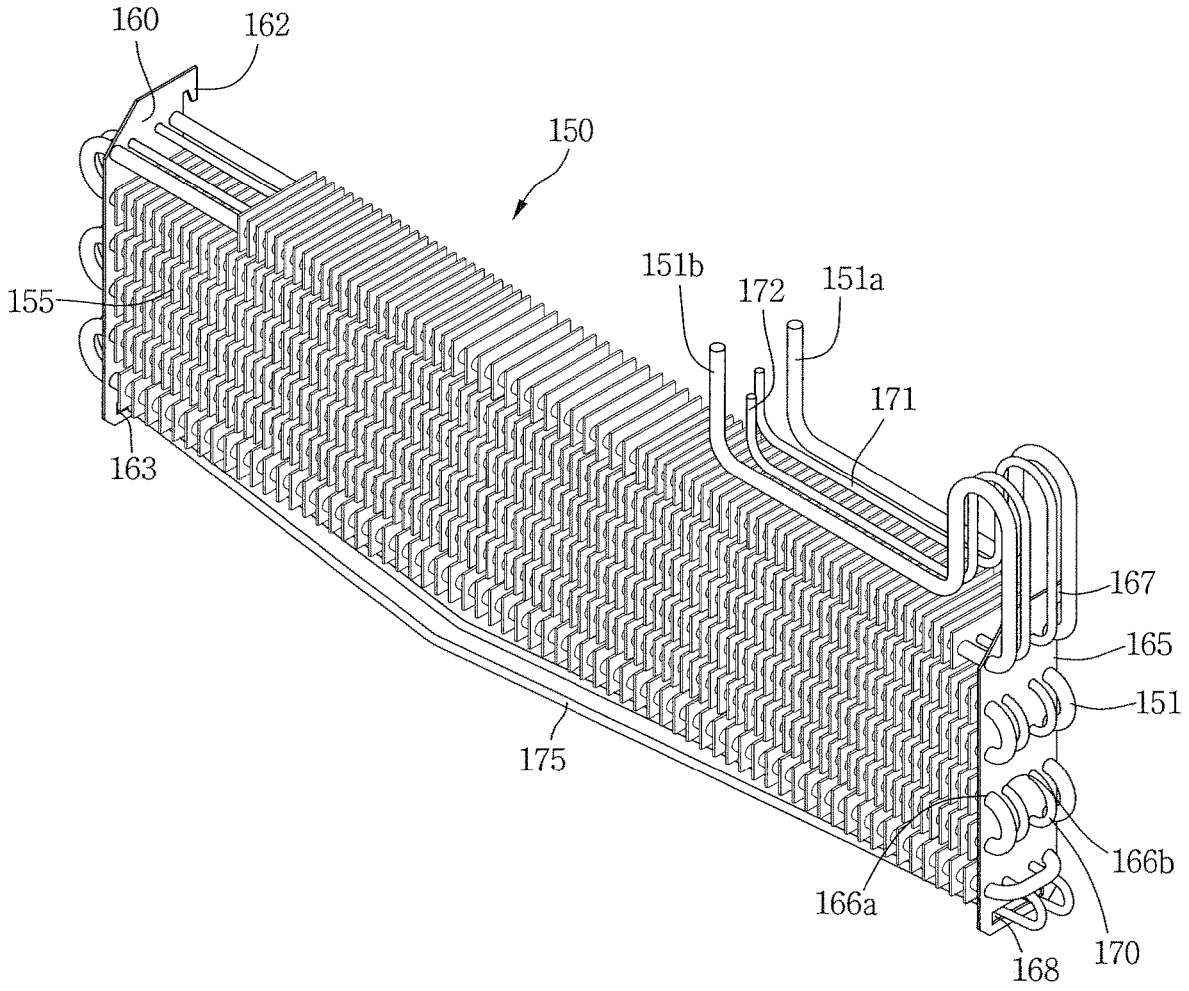
FIG. 6 is a view of an example configuration of an example evaporator.
Figure 7:
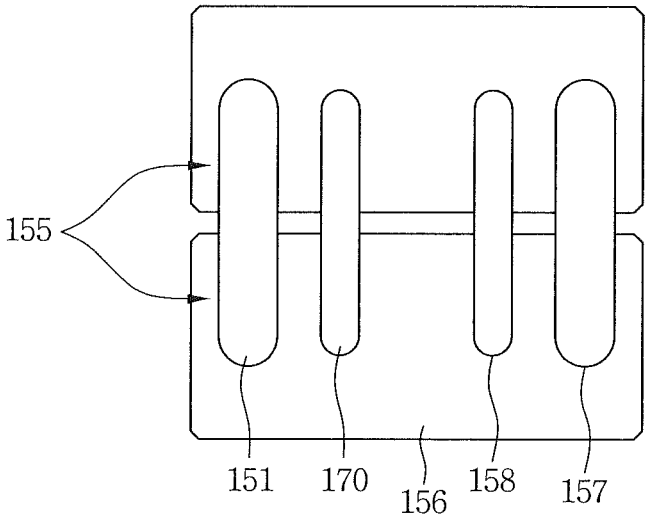
FIG. 7 is a view of example first and second pipes being coupled to an example fin.
Figure 8:
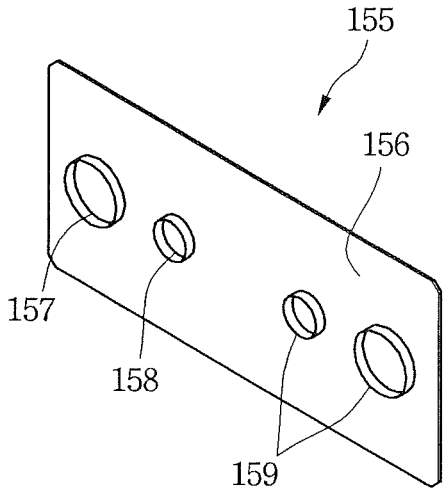
FIGS. 8 to 11 are views of example configurations of example fins.

FIG. 6 illustrates an example. FIG. 7 illustrate an example first pipe and an example second pipe. FIG. 8 illustrates an example fin.

Referring to FIG. 6, the evaporator 150 includes a plurality of refrigerant pipes 151 and 170 through which the refrigerants having different states from each other flow, and a fin 155 which is coupled to the plurality of refrigerant pipes 151 and 170 and increases a heat exchange area between the refrigerant and a fluid.

In some implementations, the plurality of refrigerant pipes 151 and 170 include the first pipe 151 through which the refrigerant depressurized in the first expander 105 flows during the first operation mode of the refrigerator 10, and the second pipe 170 through which the refrigerant flowing the first connection path 182 is supplied during the second operation mode of the refrigerator 10.

That is, the second pipe 170 forms at least a part of the hot gas paths 182 and 184, and may be referred to as a "hot gas pipe". The refrigerant of the second pipe 170 is the high temperature refrigerant compressed in the compressor 101, and may be depressurized in the first expander 105, and may have a higher temperature than that of the refrigerant flowing through the first pipe 151.

The evaporator 150 further includes coupling plates 160 and 165 which fix the first pipe 151 and the second pipe 170.

In some implementations, a plurality of coupling plates 160 and 165 may be provided at both sides of the evaporator 150. In some implementations, the coupling plates 160 and 165 include a first plate 160 which supports one side of each of the first pipe 151 and the second pipe 170, and a second plate 165 which supports the other side of each of the first pipe 151 and the second pipe 170. The first and second plates 160 and 165 may be disposed to be spaced apart from each other.

The first pipe 151 and the second pipe 170 may be formed to be bent in one direction from the first plate 160 toward the second plate 165 and the other direction from the second plate 165 toward the first plate 160.

And the first and second plates 160 and 165 serve to fix both sides of the first pipe 151 and the second pipe 170, and to prevent shaking of the first pipe 151 and the second pipe 170. For example, the first pipe 151 and the second pipe 170 may be disposed to pass through the first and second plates 160 and 165.

Each of the first and second plates 160 and 165 has a plate shape which extends longitudinally, and may have through-holes 166*a* and 166*b* through which at least parts of the first pipe 151 and 170 pass. In some implementations, the through-holes 166*a* and 166*b* include a first through-hole 166*a* through which the first pipe 151 passes, and the second through-hole 166*b* through which the second pipe 170 passes.

The first pipe 151 may be disposed to pass through the first through-hole 166*a* of the first plate 160, to extend toward the second plate 165, and to pass through the first through-hole 166*a* of the second plate 165, and then a direction thereof may be changed so as to extend again toward the first plate 160.

The second pipe 170 may be disposed to pass through the second through-hole 166*b* of the first plate 160, to extend toward the second plate 165, and to pass through the second through-hole 166*b* of the second plate 165, and then a direction thereof may be changed so as to extend again toward the first plate 160.

The evaporator 150 includes a first inlet part 151*a* which guides the introduction of the refrigerant into the first pipe 151, and a first outlet part 151*b* which guides the discharge of the refrigerant flowed through the first pipe 151. The first inlet part 151*a* and the first outlet part 151*b* form at least a part of the first pipe 151.

The first inlet part 151*a* may be connected to the evaporator inlet pipe 197, and the first outlet part 151*b* may be connected to an evaporator outlet pipe 198 which is installed at an outlet side of the evaporator 150. For example, when the refrigerator 10 performs the first operation mode, the two-phase refrigerant depressurized in the first expander 105 is introduced into the evaporator 150 through the first inlet part 151*a*, evaporated therein, discharged from the evaporator 150 through the first outlet part 151*b*, and flows through the evaporator outlet pipe 198.

The evaporator 150 includes a second inlet part 171 which guides the introduction of the refrigerant into the second pipe 170, and a second outlet part 172 which guides the discharge of the refrigerant flowed through the second pipe 170. The second inlet part 171 and the second outlet part 172 form at least a part of the second pipe 170.

The second inlet part 171 may be connected to the first connection path 182, and the second outlet part 172 may be connected to the second connection path 184. For example, when the refrigerator 10 performs the second operation mode, the high temperature refrigerant flowing through the first connection path 182 is introduced into the evaporator 150 through the second inlet part 171, removes frost formed on the evaporator 150 while heat is exchanged, is discharged from the evaporator 150 through the second outlet part 172, and flows through the second connection path 184.

A plurality of fins 155 are provided to be spaced apart from each other. And the first pipe 151 and the second pipe 170 are disposed to pass through the plurality of fins 155. In some implementations, the fins 155 may be disposed to vertically and horizontally form a plurality of rows.

The coupling plates 160 and 165 include the hooks 162 and 167 which are coupled to the inner case 13. The hooks 162 and 167 are disposed at upper portions of the coupling plates 160 and 165, respectively. In some implementations, the hooks 162 and 167 include a first hook 162 which is provided at the first plate 160, and a second hook 167 which is provided at the second plate 165.

First and second support parts 163 and 168 through which the second pipe 170 passes are formed at the coupling plates 160 and 165, respectively. The first and second support parts 163 and 168 are disposed at lower portions of the coupling plates 160 and 165, respectively. In some implementations, the first and second support parts 163 and 168 include a first support part 163 which is provided at the first plate 160, and a second support part 168 which is provided at the second plate 165.

The second pipe 170 includes an extension part 175 which forms a lower end of the evaporator 150. In some implementations, the extension part 175 is formed to extend downward further than a lowermost fin 155 of the plurality of fins 155. And the extension part 175 is located inside a water collection part 180 (referring to FIG. 11) which will be described later, and may supply heat to remaining frost in the water collection part 180. Defrosted water may be drained to a machinery compartment 50.

Due to the extension part 175, the second pipe 170 may have a shape which is inserted into the first and second support parts 163 and 168 and extends to a central portion of the evaporator 150. That is, due to a configuration in which the second pipe 170 passes and extends through the first and second support parts 163 and 168, the extension part 175 may be stably supported by the evaporator 150.

The first pipe 151 and the second pipe 170 may be installed to pass through the plurality of fins 155. The plurality of the fins 155 may be disposed to be spaced apart from each other at a predetermined distance. In some implementations, each of the fins 155 includes a fin body 156 having an approximately quadrangular plate shape, and a plurality of through-holes 157 and 158 which are formed at the fin body 156 and through which the first pipe 151 and the second pipe 170 pass. The plurality of through-holes 157 and 158 includes a first through-hole 157 through which the first pipe 151 passes, and a second through-hole 158 through which the second pipe 170 passes. The plurality of through-holes 157 and 158 may be disposed in one row.

An inner diameter of the first through-hole 157 may have a size different from that of an inner diameter of the second through-hole 158. For example, the inner diameter of the first through-hole 157 may be formed larger than that of the second through-hole 158. In other words, an outer diameter of the first pipe 151 may be formed larger than that of the second pipe 170.

This is because the first pipe 151 guides the flow of the refrigerant which performs an innate function of the evaporator 150, and thus a relatively large flow rate of the refrigerant is required. However, since the second pipe 170 guides the flow of the high temperature refrigerant for a predetermined time only when the defrosting operation of the evaporator 150 is required, a relatively small flow rate of the refrigerant is required.

The fin 155 further includes a collar 159 which protrudes from each of the first and second through-holes 157 and 158. The collar 159 may be understood as a structure which increases a contact area of each of the first and second pipes 151 and 170 inserted into the first and second through-holes 157 and 158, and reduces thermal resistance. The first and second pipes 151 and 170 may be inserted into the first and second through-holes 157 and 158, respectively, and then may be in close contact with the collar 159 through a pipe expanding process.

A plurality of first through-holes 157 and a plurality of second through-holes 158 are formed. In some implementations, two second through-holes 158 may be disposed to be arranged between two first through-holes 157. In other words, the plurality of second through-holes 158 may be disposed between one first through-hole 157 and other first through-hole 157. And corresponding to such an arrangement of the first and second through-holes 157 and 158, a plurality of second pipes 170 may be located between a plurality of first pipes 151.

Figure 9:
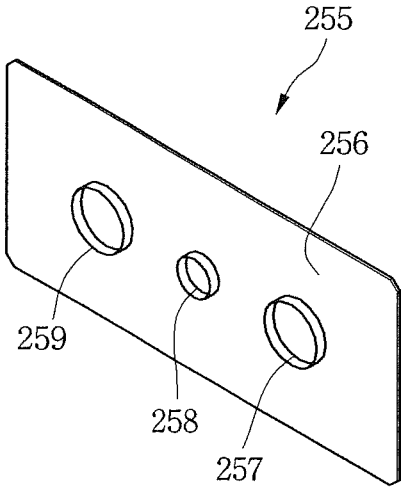
Figure 10:
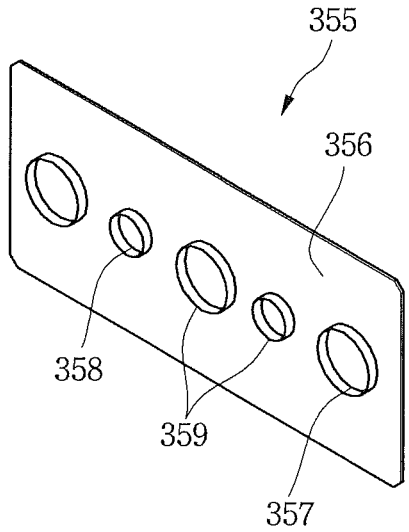

FIGS. 9 and 10 illustrate example fins.

First, referring to FIG. 9, a fin 255 includes a fin body 256, and a plurality of through-holes 257 and 258 which are formed at the fin body 256 and through which the first pipe 151 and the second pipe 170 pass. The plurality of through-holes 257 and 258 include a first through-hole 257 through which the first pipe 151 passes, and a second through-hole 258 through which the second pipe 170 passes. The plurality of through-holes 257 and 258 may be disposed in one row.

An inner diameter of the first through-hole 257 may be formed larger than that of the second through-hole 258. And the fin 255 further includes a collar 259 which protrudes from each of the first and second through-holes 257 and 258.

The second through-hole 258 may be disposed between a plurality of first through-holes 257. In some implementations, one second through-hole 258 may be disposed to be arranged between two first through-holes 257. And corresponding to such an arrangement of the first and second through-holes 257 and 258, the second pipe 170 may be located between a plurality of first pipes 151.

Next, referring to FIG. 10, a fin 355 includes a fin body 356, and a plurality of through-holes 357 and 358 which are formed at the fin body 356 and through which the first pipe 151 and the second pipe 170 pass. The plurality of through-holes 357 and 358 include a first through-hole 357 through which the first pipe 151 passes, and a second through-hole 358 through which the second pipe 170 passes. The plurality of through-holes 357 and 358 may be disposed in one row.

An inner diameter of the first through-hole 357 may be formed larger than that of the second through-hole 358. And the fin 355 further includes a collar 359 which protrudes from each of the first and second through-holes 357 and 358.

A plurality of first through-holes 357 and a plurality of second through-holes 358 are formed. In some implementations, the plurality of first through-holes 357 and the plurality of second through-holes 358 may be alternately disposed. For example, three first through-holes 357 may be disposed to be spaced apart from each other, and two second through-holes 358 may be disposed to be spaced apart from each other. And one second through-hole 358 may be disposed between two first through-holes 357. And corresponding to such an arrangement of the first and second through-holes 357 and 358, the first pipes 151 may be transversely disposed in three rows, and the second pipes 170 may be disposed in two rows, and each row of the first and second pipes 151 and 170 may be alternately disposed.

Figure 11:
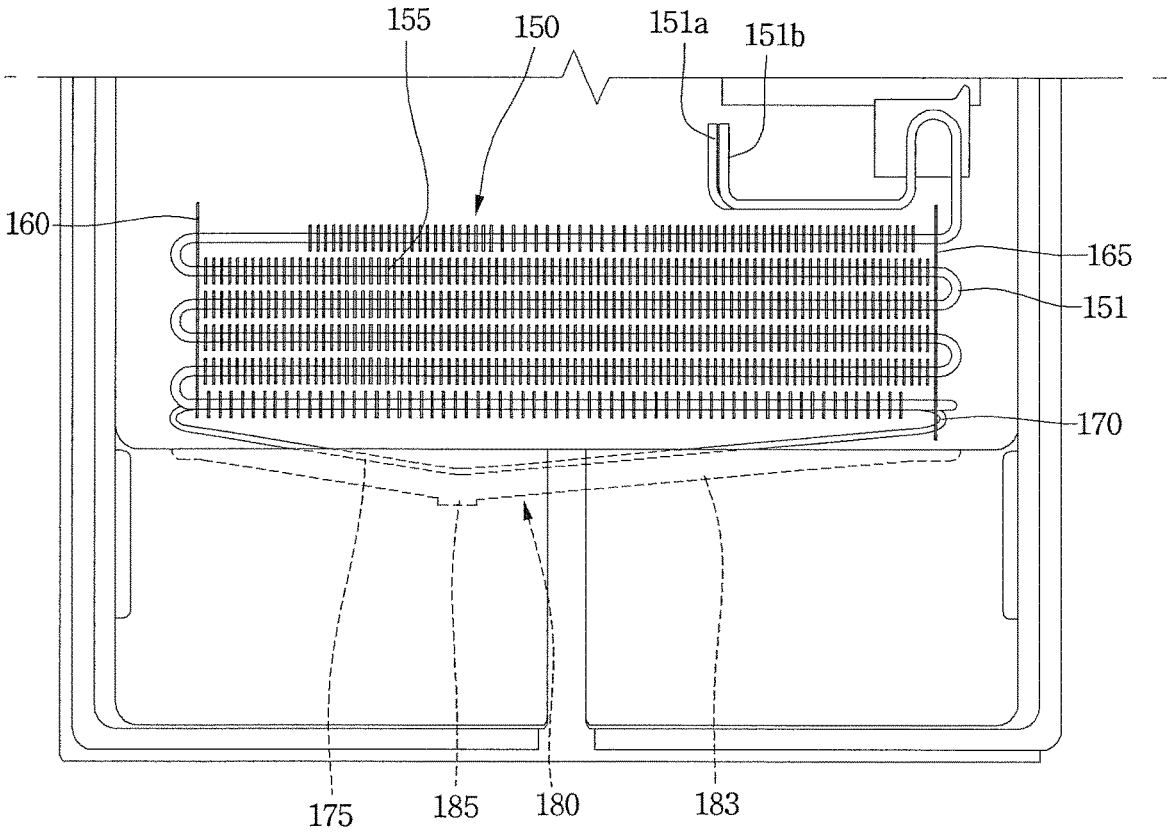
Figure 12:
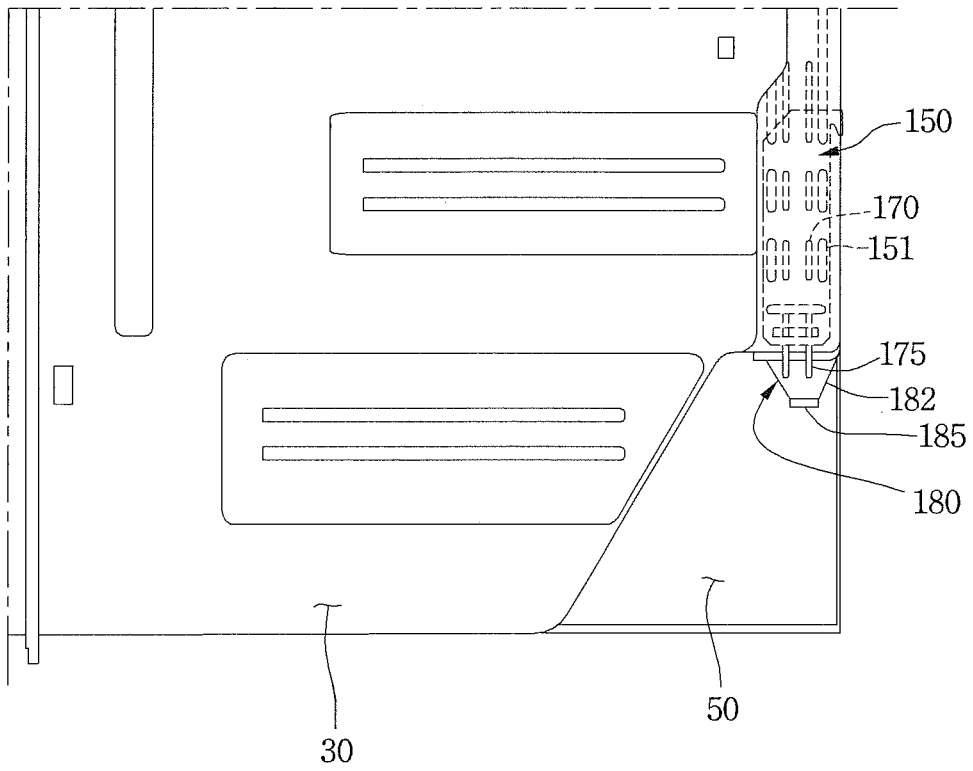

FIGS. 11 and 12 illustrate example freezer compartment evaporators.

Referring to FIGS. 11 and 12, the refrigerator 10 further includes the water collection part 180 which is installed at a lower side of the evaporator 150 to collect ice or water removed from the evaporator 150. The water collection part 180 extends in left and right directions to have a width corresponding to a transverse width of the evaporator 150.

The water collection part 180 includes an inclined surface 183 which extends to be inclined downward toward an approximately central portion of the water collection part 180. Due to the inclined surface 182, the ice or the water removed from the evaporator 150 may flow toward the approximately central portion of the water collection part 180.

A discharge part 185 through which the water stored in the water collection part 180 is discharged downward is formed at the approximately central portion of the water collection part 180. That is, the inclined surface 182 may extend to be inclined from both sides of the water collection part 180 toward the discharge part 185.

The water discharged through the discharge part 185 may be introduced into the machinery compartment 50. A drainage pipe may be connected to the discharge part 185. The drainage pipe may extend downward from the discharge part 185, and may guide the water to a defrosted water pan installed at the machinery compartment 50.

The extension part 175 of the second pipe 170 may be located inside the water collection part 180. In some implementations, the extension part 175 of the second pipe 170 includes a portion which extends to be inclined downward corresponding to an inclined shape of the water collection part 180. The extension part 175 may extend to be close to an upper surface of the water collection part 180 or to be spaced apart therefrom in a preset distance. The refrigerant flowing through the extension part 175 serves to melt the ice removed from the evaporator 150 and falling into the water collection part 180.

In some implementations, even when the ice of the evaporator 150 falls into the water collection part 180 while being not completely melted, a phase of the ice may be changed by heat supplied from the extension part 175 of the second pipe 170.

Figure 13:
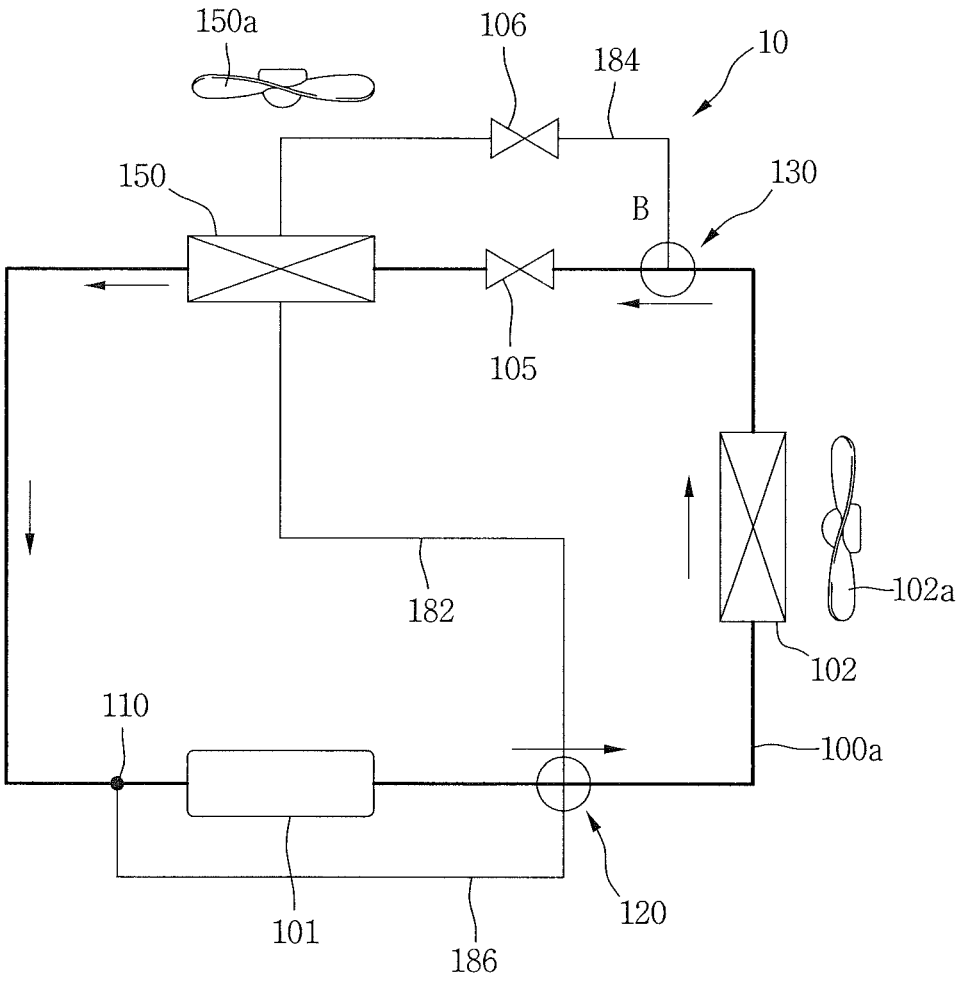
FIGS. 13 and 14 are cycle views of example flows of a refrigerant when a refrigerator performs an example operation mode.
Figure 14:
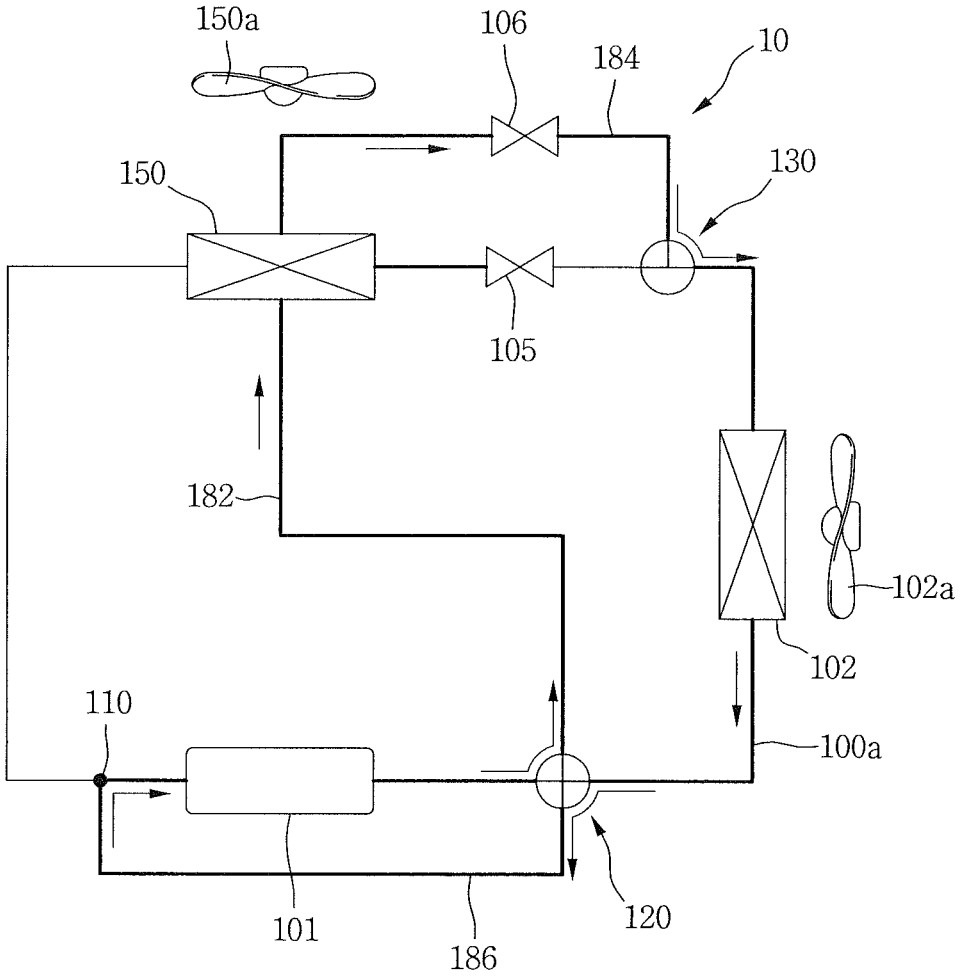

FIGS. 13 and 14 illustrate example flows of a refrigerant during example operation modes.

Referring to FIG. 13, when the refrigerator 10 performs the first operation mode, e.g., the cooling mode which cools the storage compartments 20 and 30, the first valve unit 120 and the second valve unit 130 may be controlled in a predetermined operation mode. The first operation mode may be referring to as a "general mode". When the refrigerator 10 performs the first operation mode, the first valve unit 120 may be controlled in the first operation mode.

In some implementations, the refrigerant compressed in the compressor 101 is introduced into the first port 121 of the first valve unit 120, and discharged through the second port 123. The refrigerant discharged from the first valve unit 120 may be introduced into the condenser 102, and then may be condensed.

The refrigerant passed through the condenser 102 is introduced into the second valve unit 130. The second valve unit 130 may be controlled in the first operation mode. In some implementations, the refrigerant passed through the condenser 102 is introduced into the first port 131 of the second valve unit 130, and discharged through the second port 133. The refrigerant discharged from the second valve unit 130 is introduced into the first pipe 151 of the evaporator 150 via the evaporator inlet pipe 197. At this point, the refrigerant may be depressurized while passing through the first expander 105, and then may be introduced into the evaporator 150.

The refrigerant is evaporated while flowing through the first pipe 151, then discharged from the evaporator 150, and flows through the evaporator outlet pipe 198. And the refrigerant may be suctioned into the compressor 101 and then may be compressed. This cycle may be repeated. That is, when the refrigerator 10 performs the first operation mode, the first valve unit 120 and the second valve unit 130 may be operated to restrict the flow of the refrigerant in the first and second connection paths 182 and 184.

Referring to FIG. 14, when the refrigerator 10 performs the second operation mode, e.g., the defrosting mode which defrosts the evaporator 150, the first valve unit 120 and the second valve unit 130 may be controlled in a predetermined operation mode. When the refrigerator 10 performs the second operation mode, the first valve unit 120 may be controlled in the second operation mode.

In some implementations, the refrigerant compressed in the compressor 101 is introduced into the first port 121 of the first valve unit 120, and discharged through the third port 125. The refrigerant discharged from the first valve unit 120 flows through the first connection path 182.

The refrigerant in the first connection path 182 is introduced into the evaporator 150 through the second pipe 170 of the evaporator 150. That is, the high temperature refrigerator compressed in the compressor 101 may be introduced into the evaporator 150. In this process, the refrigerant may supply heat to the evaporator 150, and thus may remove the ice formed on the evaporator 150. And the refrigerant flowing through the second pipe 170 of the evaporator 150 is discharged into the second connection path 184, and may be depressurized in the second expander 106.

The second valve unit 130 may be controlled in the second operation mode. In some implementations, the refrigerant in the second connection path 184 is introduced into the third port 135 of the second valve unit 130, and discharged through the first port 131. The refrigerant discharged from the second valve unit 130 is introduced into the condenser 102, and may be evaporated while passing through the condenser 102. At this time, the condenser fan 102*a* may be operated in a preset RPM.

The refrigerant discharged from the condenser 102 may be introduced into the second port 123 of the first valve unit 120, and may be discharged through the fourth port 127 thereof. The refrigerant discharged from the first valve unit 120 may flow through the third connection path 186, and may be suctioned into the compressor 101 via the combination part 110. This cycle may be repeated.

Like this, in the defrosting operation mode of the evaporator 150, the high temperature refrigerant compressed in the compressor 101 may defrost the evaporator 150 while passing through the evaporator 150. And during a defrosting process, the refrigerant may be condensed, may be depressurized while passing through the second expander 106, and may be evaporated while passing through the condenser 102. Consequently, during the second operation mode of the refrigerator 10, functions of the condenser 102 and the evaporator 150 are changed contrary to a case of the first operation mode, e.g., the condenser 102 and the evaporator 150 may serve as the evaporator and the condenser, respectively. In this process, the evaporator 150 may be effectively defrosted.

FIGS. 15 to 19 are graphs of example results of an experiment performed under example conditions in a refrigerator.

Since a flow rate of the refrigerant, a defrosting time, and a temperature of the condenser 102 may be changed according to a design dimension, for example, a length or a diameter of the second expander 106 operated to depressurize the refrigerant when the refrigerator 10 performs the second operation mode, the design dimension of the second expander 106 may be determined in advance so that the operation efficiency of the compressor 101 is improved while reducing the defrosting time.

Figure 15:
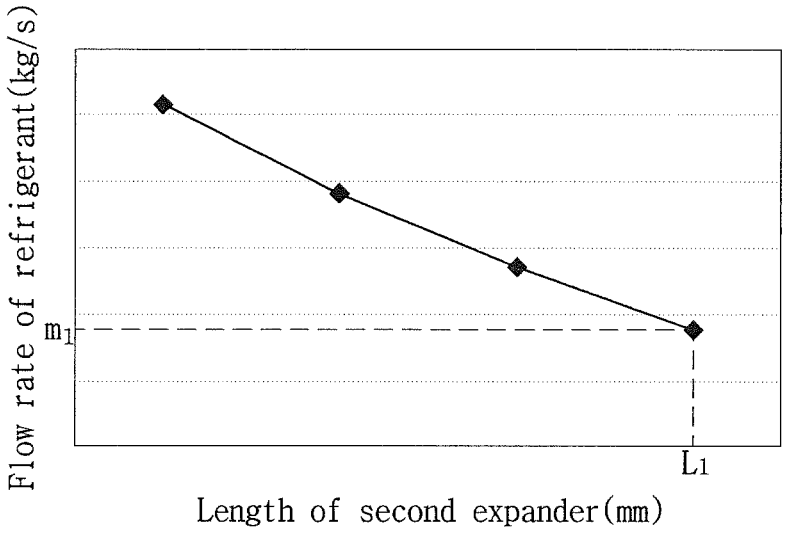
FIGS. 15 to 19 are graphs of example results of an experiment performed under example conditions in a refrigerator.

First, FIG. 15 is an experimental graph illustrating a state in which the flow rate kg/s of the refrigerant is changed according to a length mm of the second expander 106. For example, a diameter of the second expander 106 has a constant value of A mm. For example, the value of A may be 0.75 mm. And input work or input power (hereinafter, referred to as input work) of the compressor 101 is fixed at a set value.

Referring to FIG. 15, in the defrosting operation mode of the refrigerator 10, as the length of the second expander 106 is increased, the flow rate of the refrigerant is reduced. That is, when the length of the second expander 106 is increased, the resistance is increased in an aspect of the flow of the refrigerant, and thus the flow of the refrigerant is reduced.

To maintain defrosting performance of the evaporator 150 at a required level or more, the flow of the refrigerant should have a set flow rate value m1 or more. In an experiment, the length of the second expander 106 which obtains the set flow rate value m1 is determined to be L1. For example, the set flow rate value m1 is 0.00033 kg/s, and L1 is 2,000 mm, and thus the length of the second expander 106 may be determined to be 2,000 mm or less.

Figure 16:
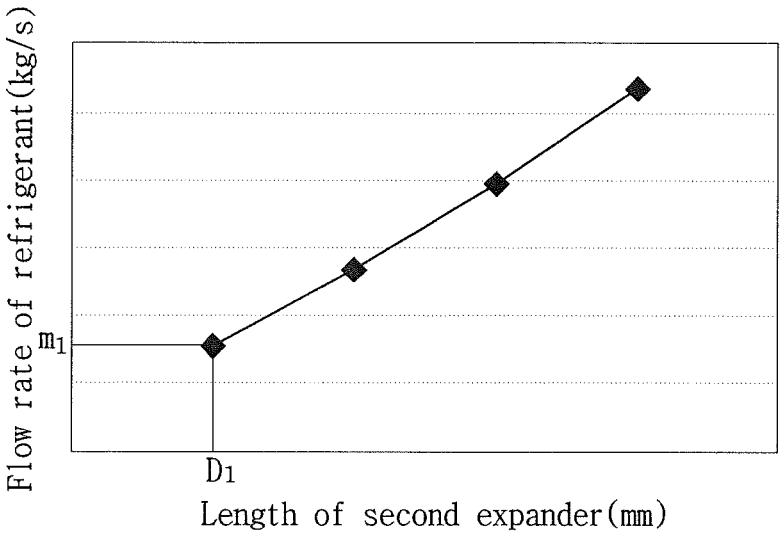

FIG. 16 is an experimental graph illustrating the state in which the flow rate kg/s of the refrigerant is changed according to a diameter mm of the second expander 106. For example, a length of the second expander 106 has a constant value of B mm. For example, the value of B may be 2,000 mm. And the input work of the compressor 101 is fixed at a set value.

Referring to FIG. 16, in the defrosting operation mode of the refrigerator 10, as the diameter of the second expander 106 is increased, the flow rate of the refrigerant is increased. That is, when the diameter of the second expander 106 is increased, the resistance is reduced in the aspect of the flow of the refrigerant, and thus the flow of the refrigerant is increased.

To maintain defrosting performance of the evaporator 150 at a required level or more, the flow of the refrigerant should have the set flow rate value m1 or more. In an experiment, the diameter of the second expander 106 which obtains the set flow rate value m1 or more is determined to be D1. For example, D1 is 0.70 mm, and thus the diameter of the second expander 106 may be determined to be 0.70 mm or more.

Figure 17:
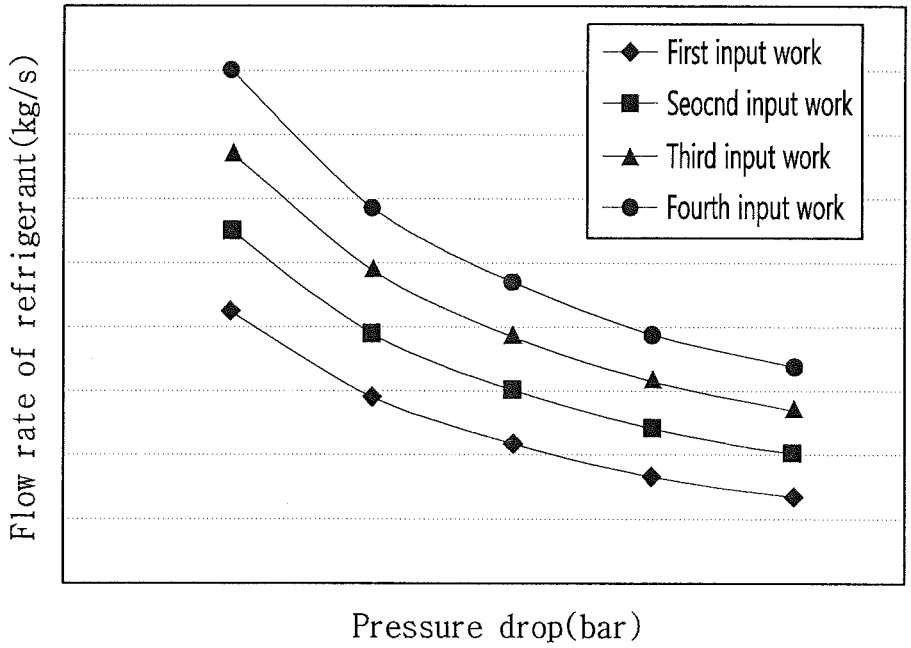

FIG. 17 is an experimental graph illustrating a change of the flow rate kg/s of the refrigerant which circulates in the refrigeration cycle of the refrigerator 10 according to an increase in a pressure drop bar with respect to a predetermined input work of the compressor 101.

An experiment is performed four times while the input work of the compressor 101 is changed. The input work is increased from a first input work to a fourth input work of the compressor 101. For example, a second input work may be determined larger by 20% than the first input work, a third input work may be determined larger by 40% than the first input work, and the fourth input work may be determined larger by 60% than the first input work. This definition may be equally applied to FIG. 13.

The pressure drop of a horizontal axis indicates a pressure which is reduced in the second expander 106 after the evaporator 150 is defrosted. Based on a predetermined pressure drop, it may be understood that the flow rate of the refrigerant is increased as the input work of the compressor 101 is increased.

And as the pressure drop is reduced, the flow rate of the refrigerant may be increased. That is, as an opening degree of the second expander 106 is increased, the pressure drop may be reduced, but the flow rate of the refrigerant may be increased. For example, when the second expander 106 is formed of a capillary tube, as a diameter of the capillary tube becomes larger or a length of the capillary tube becomes shorter, the pressure drop may be reduced, and the flow rate of the refrigerant may be increased.

Figure 18:
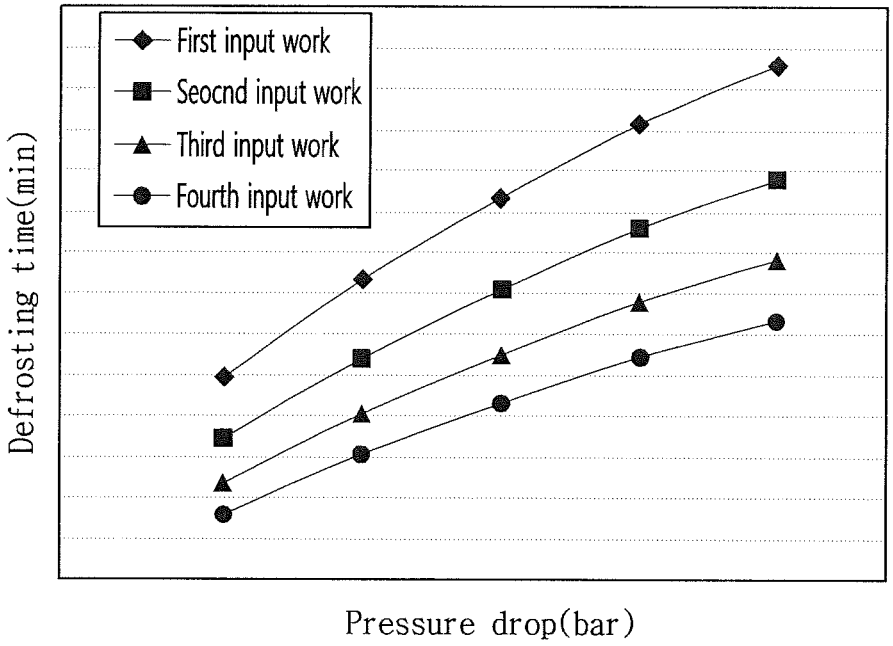

Referring to FIG. 18, as the pressure drop becomes smaller, the defrosting time becomes shorter. That is, as the pressure drop becomes smaller, the flow rate of the refrigerant flowing through the hot gas paths 182 and 184 is increased. Accordingly, the defrosting performance is improved, and thus the defrosting time becomes shorter. And as the work input to the compressor 101 is increased, the flow rate of the refrigerant circulating the system is increased, and the defrosting time may be shorter.

Figure 19:
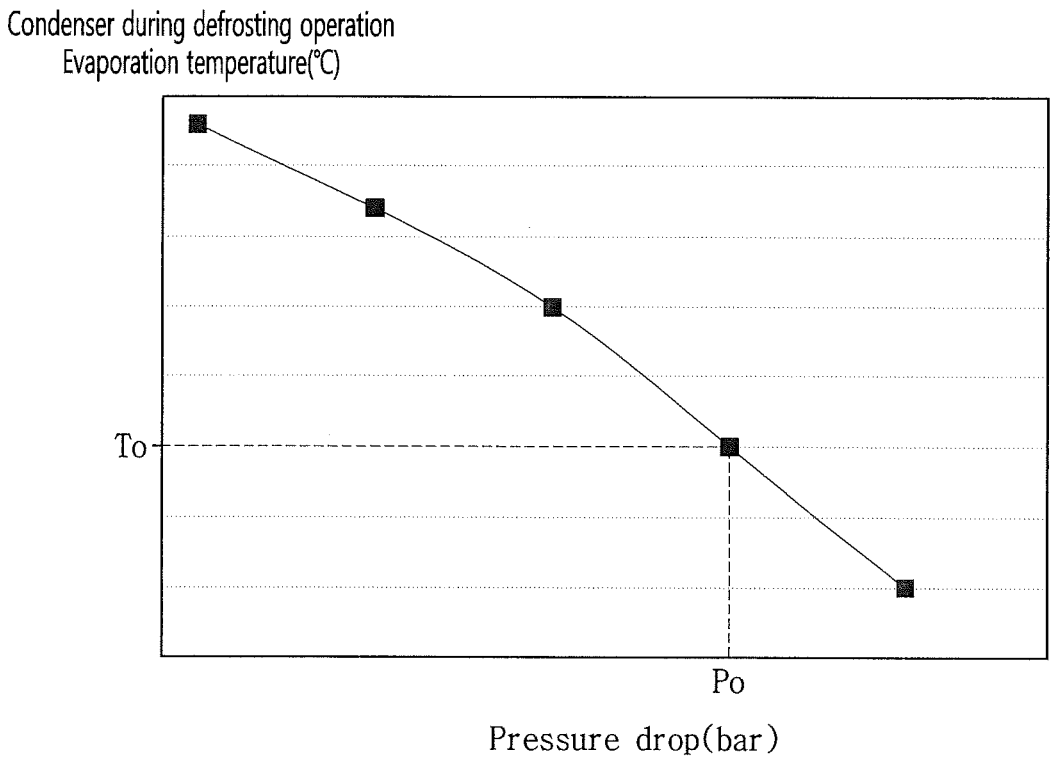

In FIG. 19, it may be understood that an evaporation temperature of the condenser 102 during the defrosting operation which is indicated at a vertical axis is reduced, as the pressure drop of the horizontal axis is increased. The evaporation temperature of the condenser 102 serves as a factor which determines a suction temperature of the refrigerant suctioned into the compressor 101, and thus it is important.

Therefore, to maintain the evaporator temperature of the condenser 102 at a set value To or less while ensuring the defrosting performance having a set level or more, the refrigerator 10 may be designed so that the pressure drop is maintained at a set value Po or more. That is, the length or an inner diameter of the second expander 106 may be determined so that the pressure drop is maintained at the set value Po or more. For example, the set value To of the evaporation temperature may be about −5° C., and the set value Po of the pressure drop may be about 2.5 bar.

In brief, as illustrated in FIGS. 10 to 14, as the pressure drop becomes smaller, the flow rate of the refrigerant may be increased, and the defrosting time may be shorter. However, when the pressure drop is too small, the evaporation temperature or an evaporation pressure of the refrigerant is increased, and thus a load of the compressor 101 may be increased. Therefore, to maintain the pressure drop at the preset value or more when considering the operation efficiency of the compressor 101, the inner diameter of the second expander 106 should be determined to be the preset value or less and the length thereof should be determined to be the preset value or more.

In some implementations, based on experimental data and the preset input work of the compressor 101, the inner diameter of the second expander 106 is determined to be 0.70 mm or more and 0.90 mm or less, and the length thereof is determined to be 1,700 mm or more and 2,000 mm or less. For example, the preset input power of the compressor 101 may be 60 W.

In some implementations, since the defrosting of the evaporator can be performed using the high temperature refrigerant (or the hot gas), it is not necessary to install the conventional defrosting heater, and thus it is possible to reduce the cost.

In some implementations, when the defrosting operation is performed, a reverse cycle is driven, and the high temperature refrigerant discharged from the compressor can flow to the evaporator which will be defrosted, can perform the defrosting operation, can be condensed during the defrosting operation, then can be depressurized, and can be evaporated while passing through the condenser.

Also, the valve unit is provided at the inlet side and the outlet side of the condenser, and the flowing of the refrigerant can be controlled during the general operation or the defrosting operation, and thus the cooling operation of the storage compartment and the defrosting operation of the evaporator can be effectively performed.

Also, the evaporator includes the first pipe through which the refrigerant to be evaporated flows, the second pipe through which the high temperature refrigerant flows, and the fin to which the first and second pipes are coupled, and the ice formed on the evaporator can be melted during the defrosting operation using the high temperature refrigerant, and thus the defrosting efficiency can be improved.

In some implementations, the defrosting of the evaporator is performed in a convection current method or a radiant method using the defrosting heater. In some implementations, the heat of the high temperature refrigerant can be transferred to the evaporator in a heat conduction method, and the defrosting efficiency is improved, and thus the defrosting time becomes shorter, and a temperature of the storage compartment can be prevented from being excessively increased during the defrosting operation.

Also, since the fin and the first and second pipes are coupled through the collar provided at the fin, and the first and second pipes are in close contact with the collar of the fin through the pipe expanding process, contact thermal resistance can be reduced, and thus the defrosting time can be shortened.

Also, since the extension part formed by extending at least a part of the second pipe is provided at the lower portion of the evaporator, and the high temperature refrigerant flows therethrough, the remaining ice in the water collection part can be effectively melted, and the defrosted water can be drained to the defrosted water pan.

Also, due to an example configuration of the refrigeration cycle, the defrosting of the evaporator using the high temperature refrigerant can be effectively performed. In particular, when the freezer compartment evaporator is defrosted, the cooling of the refrigerator compartment can be performed by driving the refrigerator compartment evaporator, and when the refrigerator compartment evaporator is defrosted, the cooling of the freezer compartment can be performed by driving the freezer compartment evaporator. Eventually, the cooling performance can be prevented from being excessively degraded by the defrosting operation.

What is claimed is:

1. A refrigerator comprising:

a compressor that is configured to compress refrigerant;

a heat exchanger that is configured to condense compressed refrigerant during a first operation mode, and evaporate refrigerant during a second operation mode;

a first expander that is configured to depressurize condensed refrigerant;

an evaporator that is configured to evaporate depressurized refrigerant and that comprises a first pipe, a second pipe through which refrigerant flows, and a fin coupled to the first pipe and the second pipe, wherein the first pipe and the second pipe are adjacent to each other;

an evaporator inlet pipe in which the first expander is located;

an evaporator outlet pipe that is in fluid communication with the first pipe of the evaporator and that extends towards the compressor;

a first valve unit that is located at an outlet side of the compressor and that is configured to guide compressed refrigerant from the compressor to the heat exchanger;

a first connection path that extends from the first valve unit to the evaporator and that is in fluid communication with the second pipe of the evaporator;

a second connection path that is in fluid communication with the first connection path;

a second expander that is located in the second connection path; and a three-way valve (i) that is located at an outlet side of the heat exchanger, (ii) that is configured to guide condensed refrigerant from the heat exchanger to the evaporator, and (iii) that comprises:

a first port that is coupled to a pipe that connects the heat exchanger with the three-way valve;

a second port that is coupled to the evaporator inlet pipe; and a third port, wherein the second connection path is coupled to the second pipe of the evaporator, extends toward the three-way valve, and is coupled to the third port, wherein the evaporator inlet pipe is coupled to the first pipe of the evaporator, extends toward the three-way valve, and is coupled to the second port, wherein, based on performing the first operation mode:

the first valve unit is configured to guide refrigerant from the compressor to the heat exchanger, and the three-way valve is operated such that the first port and the second port are opened and the third port is closed, the three-way valve being configured to guide the refrigerant condensed at the heat exchanger to the first pipe via the first expander and to prevent the refrigerant from flowing into the second pipe, the first connection path, and the second connection path, and wherein, based on performing the second operation mode:

the first valve unit is configured to guide the refrigerant from the compressor to the first connection path and is configured to guide the refrigerant evaporated at the heat exchanger to a suction side pipe of the compressor, and the three-way valve is operated such that the first port and the third port are opened and the second port is closed, the three-way valve being configured to guide refrigerant from the second connection path to the heat exchanger and to prevent the refrigerant from flowing into the first pipe, the evaporator inlet pipe, and the evaporator outlet pipe.

2. The refrigerator according to claim 1, wherein the first expander or the second expander comprises a capillary tube.

3. The refrigerator according to claim 1, wherein the first valve unit comprises a four-way valve that includes four ports, and that comprises:

a first port that is connected to an outlet pipe of the compressor;

a second port that is connected to an inlet pipe of the heat exchanger; and a third port that is connected to the first connection path.

4. The refrigerator according to claim 3, further comprising a third connection path that extends from the first valve unit to a suction side pipe of the compressor, wherein the first valve unit further comprises a fourth port that is connected to the third connection path.

5. The refrigerator according to claim 1, wherein the fin comprises:

a first through-hole that is configured to receive the first pipe; and a second through-hole that is configured to receive the second pipe and that has an inner diameter that is smaller than an inner diameter of the first through-hole, wherein the first through-hole and the second through-hole are aligned along an axis that is perpendicular to a front of the refrigerator.

6. The refrigerator according to claim 5, wherein the fin further comprises:

a plurality of additional through-holes that are similar to the first through hole, wherein the second through-hole is located among the plurality of additional through-holes and the first through-hole.

7. The refrigerator according to claim 1, further comprising:

a water collection part that is located at a lower side of the evaporator and that is configured to receive ice or water condensed on the evaporator; and an extension part that is located at the second pipe, that is located inside the water collection part, and that is configured to melt ice in the water collection part by providing heat.

8. The refrigerator according to claim 7, wherein the extension part is located below the fin.

9. The refrigerator according to claim 7, wherein the water collection part comprises:

a discharge part that is configured to receive defrosted water from the water collection part; and a first inclined surface that is inclined downward from the water collection part toward the discharge part, wherein the extension part is located above the first inclined surface of the water collection part.

* * * * *